US008222579B2

(12) United States Patent
Taguchi et al.

(10) Patent No.: US 8,222,579 B2
(45) Date of Patent: Jul. 17, 2012

(54) MICROWAVE IRRADIATION SYSTEM

(75) Inventors: Masami Taguchi, Hitachi (JP); Noboru Baba, Hitachiota (JP); Kazutaka Okamoto, Tokai (JP); Tomokatsu Oguro, Mobara (JP); Toshio Ogura, Mobara (JP); Masumi Kuga, Mutsuzawa (JP)

(73) Assignee: Hitachi, Ltd., Tokyo (JP)

( * ) Notice: Subject to any disclaimer, the term of this patent is extended or adjusted under 35 U.S.C. 154(b) by 40 days.

(21) Appl. No.: 12/846,433

(22) Filed: Jul. 29, 2010

(65) Prior Publication Data

US 2011/0031239 A1 Feb. 10, 2011

(30) Foreign Application Priority Data

Jul. 31, 2009 (JP) ..... 2009-179663

(51) Int. Cl.
*H05B 6/64* (2006.01)
*H05B 6/70* (2006.01)

(52) U.S. Cl. .... 219/745; 219/690; 219/750; 204/157.15

(58) Field of Classification Search ..... 219/679, 219/695, 745, 750, 690; 204/157.15
See application file for complete search history.

(56) References Cited

U.S. PATENT DOCUMENTS 6,960,747 B2 * 11/2005 Risman ..... 219/690
7,518,092 B2 * 4/2009 Purta et al. ..... 219/695
2008/0272114 A1 11/2008 Taguchi et al.

FOREIGN PATENT DOCUMENTS

JP 59-19401 A 1/1984
JP 63-99602 A 4/1988
JP 2008-276986 A 11/2008

OTHER PUBLICATIONS

Japanese Office Action dated Jan. 10, 2012 (Three (3) pages).

* cited by examiner

*Primary Examiner* — Henry Yuen
*Assistant Examiner* — Jianying Atkisson
(74) *Attorney, Agent, or Firm* — Crowell & Moring LLP

(57) ABSTRACT

A microwave irradiation system includes first and second microwave generators, and an applicator which includes: a microwave transmission part connected to the first and second microwave generators; a reflecting plane, at an other end of the microwave transmission part of the applicator, configured to reflect microwaves from the first and the second microwave generators at such a location that a space of an object, in the microwave transmission part of the applicator between the end and the other end is irradiated with both a greater intensity of electric field and a smaller intensity of magnetic field generated by the first microwave generator and with both a greater intensity of magnetic field and a smaller intensity of electric field generated by the second microwave generator; and a filter part through which at least one of the first and second microwave generators is connected to the applicator.

3 Claims, 16 Drawing Sheets

MICROWAVE IRRADIATION SYSTEM

CROSS REFERENCE TO RELATED APPLICATIONS

This application claims the foreign priority benefit under Title 35, United States Code, §119(a)-(d) of Japanese Patent Application No. 2009-179633, filed on Jul. 31, 2009 in the Japan Patent Office, the disclosure of which is herein incorporated by reference in its entirety.

BACKGROUND OF THE INVENTION

1. Field of the Invention

The present invention relates to a microwave irradiation system for irradiating a microwave toward an object and to a microwave irradiation system for generating a chemical reaction by heating a plurality of materials included in the object.

2. Description of the Related Art

A microwave irradiation system for radiating a microwave toward an object to be heated is known. In addition, a microwave irradiation system in which an electric field and a magnetic field are independently controlled is disclosed in U.S. 2008/0272114 (claiming priority based on JP 2008-276986 A), the disclosure of which is herein incorporated by reference in its entirety.

The microwave irradiation system includes an applicator having an internal space for containing an object to be irradiated with microwaves, a first microwave irradiation system for irradiating a first microwave toward the inside space in a first mode to generate an electric field with a greater intensity and a magnetic field with a small intensity at a predetermined location within the space, and a second microwave irradiation system for irradiating a second microwave having a polarization plane orthogonal to that of the first microwave toward the inside space in a second mode to generate a magnetic field with a greater intensity and an electric field with a small intensity at the predetermined location within the space.

SUMMARY OF THE INVENTION

An aspect of the present invention provides a microwave irradiation system comprising:

first and second microwave generators, each comprising a microwave irradiating element and a microwave transmission part comprising at least one of a waveguide and a coaxial tube;

an applicator comprising:

a microwave transmission part connected to the first and second microwave transmission parts of the first and second microwave generators at one end thereof;

a reflecting plane, at an other end of the microwave transmission part of the applicator, configured to reflect microwaves from the first and the second microwave generators to generate an electromagnetic mode at such a location that a space of an object to be irradiated, in the microwave transmission part of the applicator between the end and the other end is irradiated with both an electric field having a first electric field intensity and a magnetic field having a first magnetic field intensity generated by the first microwave generator and with both a magnetic field having a second magnetic intensity and an electric field having a second electric field intensity generated by the second microwave generator, wherein the first magnetic field intensity is greater than the second magnetic intensity and the first electric field intensity is smaller than the second electric field intensity; and a filter part through which at least one of the first and second microwave generators is connected to the applicator.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

Prior to describing embodiments of the present invention, the above-mentioned related art, U.S. 2008/0272114, will be further explained. The microwave irradiation system disclosed in U.S. 2008/0272114 has a taper part which is provided because a connection part for connecting the first microwave generating part with a second microwave irradiation part has different horizontal and vertical dimensions on a cross section thereof. The taper part generates heat. Therefore all power generated by the magnetrons cannot be incident to the object and a measurement becomes difficult. The present invention provides a microwave irradiation system capable of reducing heat generation in the taper part with high irradiation efficiency.

First Embodiment

With reference to drawings will be described embodiments of the present invention.

Figure 1:
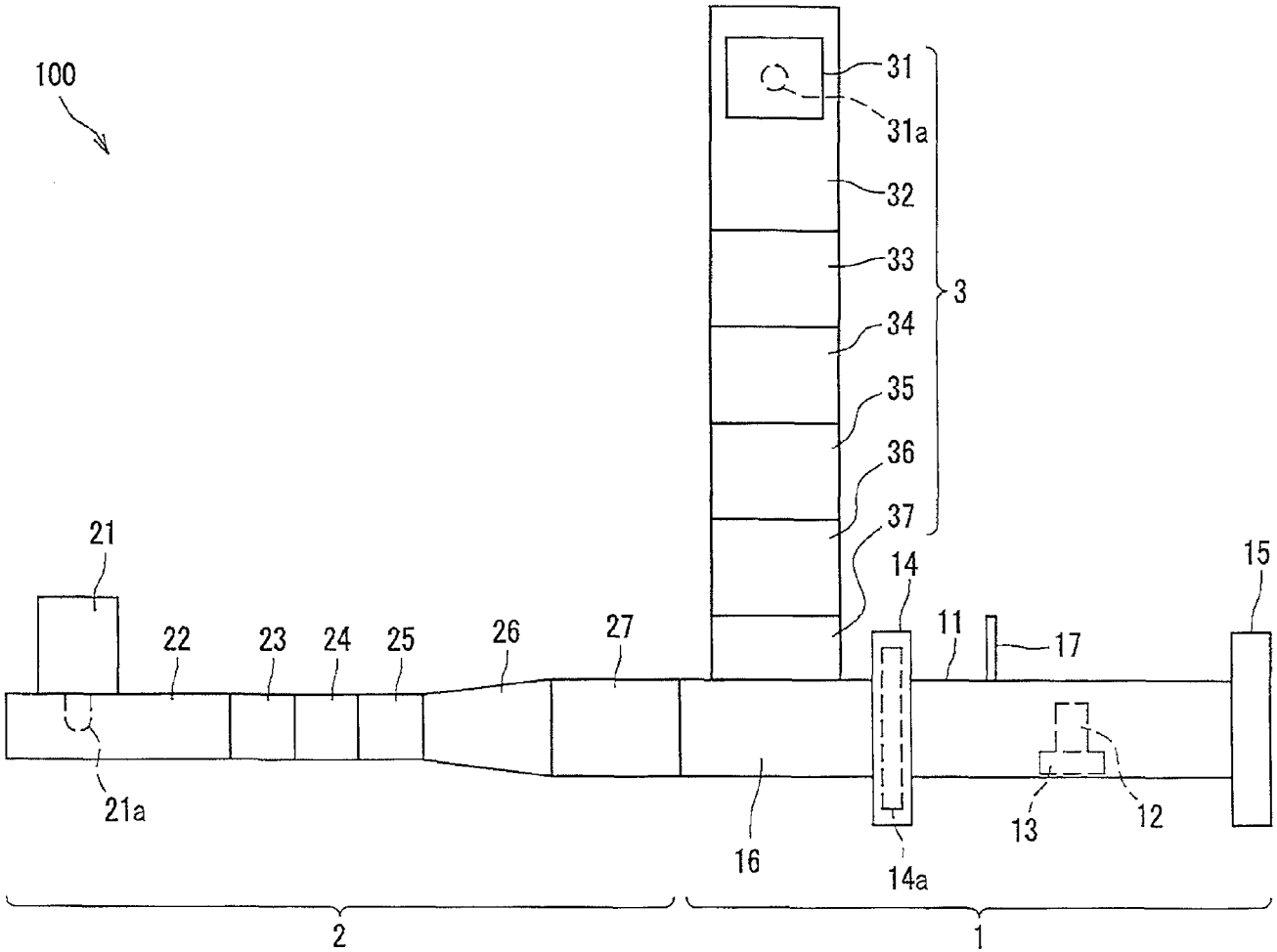
FIG. 1 is a front view of a microwave irradiation system according to a first embodiment of the present invention.

FIG. 1 is a front view of a microwave irradiation system according to a first embodiment of the present invention.

In FIG. 1, a microwave irradiation system 100 includes an applicator 1, a first microwave generator 2, and a second microwave generator 3 which are properly connected. The applicator 1 includes a rectangular sleeve member 11 made of metal, a reflector 15, a separation window 14, and a connecting member 16 for connection to the microwave generators to the applicator 1. The rectangular sleeve member 11 is provided with a supporting member 13, made of an insulator, and an object 12 to be irradiated inside the rectangular sleeve member 11, supported by the supporting member 13. A gas supply system 17 is connected to the rectangular sleeve member 11 to supply a gas such as an inert gas including, for example, argon and nitrogen to increase or decrease a pressure of inside thereof. The first microwave generator 2 includes a magnetron 21 oscillating at 2450 MHz to generate and emit a microwave power at a band of 2450 MHz; a waveguide mounting member 22 for supporting the magnetron 21 as well as effectively taking out the microwave power from an output member 21*a* of the magnetron 21; an isolator 23 for protecting the magnetron 21 from a reflection wave from the applicator 1; a power monitor 24 for measuring and displaying a status between a microwave traveling power and a microwave reflection power; a tuner 25 for adjusting an impedance for the microwave; a taper tube 26, and a microwave filter 27.

Out of these elements, the isolator 23, the power monitor 24, and the tuner 25, which are standard microwave components, are shown with waveguide components for easy explanation. The magnetron 21 which is a part of the first microwave generator 2, the waveguide mounting member 22, the isolator 23, the power monitor 24, and the tuner 25 are provided from standard waveguide system components (for example, WR430 waveguide system) for a 2-GHz band. On the other hand, a cross sectional vertical and horizontal dimensions of the rectangular sleeve member 11 which is a main part of the applicator 1 are differentiated from vertical and horizontal dimensions of the standard waveguide system components for the 2 GHz band. The taper tube 26 is disposed between the tuner 25 and the microwave filter 27 having different opening dimensions for smooth connection therebetween. Here, the taper tube 26 has different characteristic impedances at the input and output ends.

The second microwave generator 3 includes: a magnetron 21 oscillating for generating and emitting a microwave power at the band of 2450 MHz; a waveguide mounting member 32 for supporting a magnetron 31 as well as effectively taking out the microwave output from an output member 31*a* of the magnetron 31; an isolator 33 for protecting the magnetron 31 from a reflection wave from the applicator 1; a power monitor 34 for measuring and displaying a status between a microwave traveling power and a microwave reflection power; a tuner 35 for adjusting an impedance for the microwave; a taper tube 36, and an oblong waveguide 37. The isolator 33, the power monitor 34, and the tuner 35, which are standard microwave elements in the second microwave generator 3, are shown with waveguide component shapes for easy explanation similarly to the first microwave generator 2 shown in FIG. 1 and provided (selected) from standard waveguide system components (for example, WR 430 waveguide system components) for the 2-GHz band. The first microwave generator 2 is straightly connected to the opening of the applicator 1 and disposed in a direction of a center axis of the waveguide of the applicator 1. On the other hand, the second microwave generator 3 is disposed in a perpendicular direction to the center axis of the applicator 1.

Figure 2:
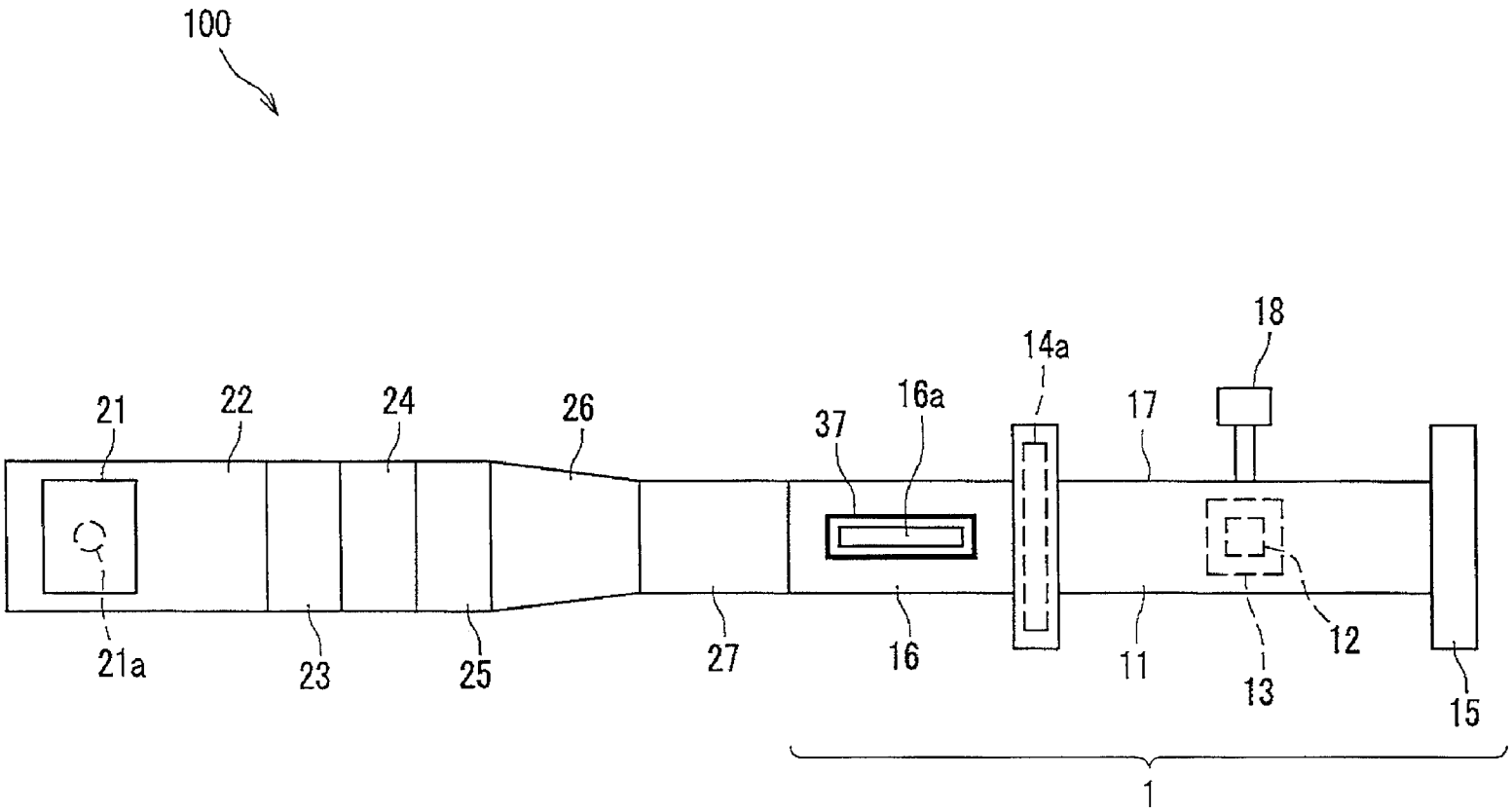
FIG. 2 is a plan view of the microwave irradiation system according to the first embodiment.

FIG. 2 is a plan view of the microwave irradiation system according to the present invention, where all components in the second microwave generator 3 are removed except the oblong waveguide 37.

An observing window 18 is provided for observation of a status of the object 12 to be irradiated with microwaves and for measurement of a temperature of the object 12. An oblong opening 16*a* is disposed on an upper surface at the connecting member 16 of the applicator 1, and a oblong waveguide 37 of the second microwave generator 3 is fixed thereto. A microwave power from the second microwave generator 3 propagates to inside of the applicator 1 through the oblong opening 16*a*.

Figure 3:
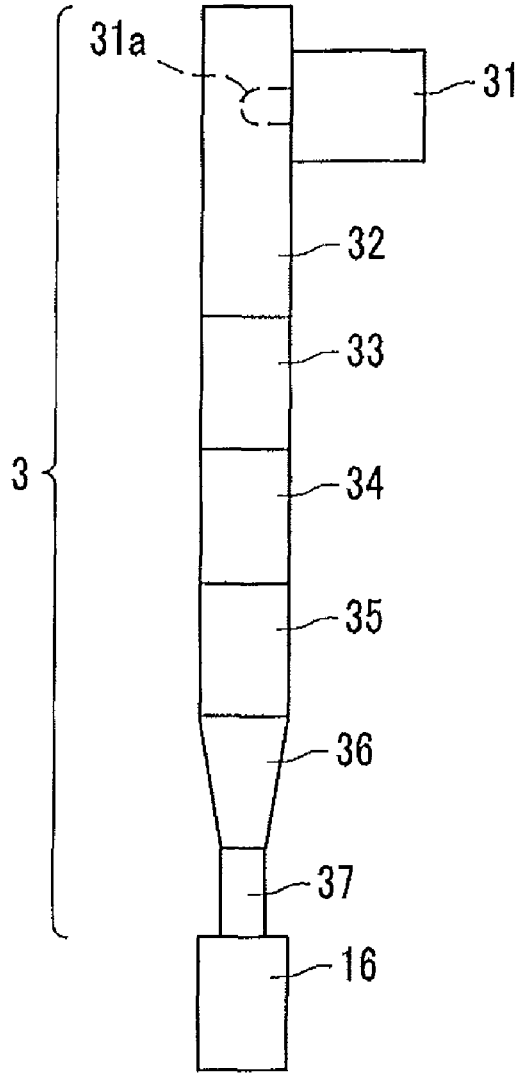
FIG. 3 is a left side elevation view of the microwave irradiation system according to the first embodiment.

FIG. 3 shows a connection status between the second microwave generator 3 and the connecting member 16 of the applicator 1 and corresponds to the side elevation view showing main parts shown in FIG. 1.

The microwave power from the second microwave generator 3 incident to the connecting member 16 also tends to advance in an opposite direction to the applicator 1, that is, in the direction of the first microwave generator 2.

Figure 4:
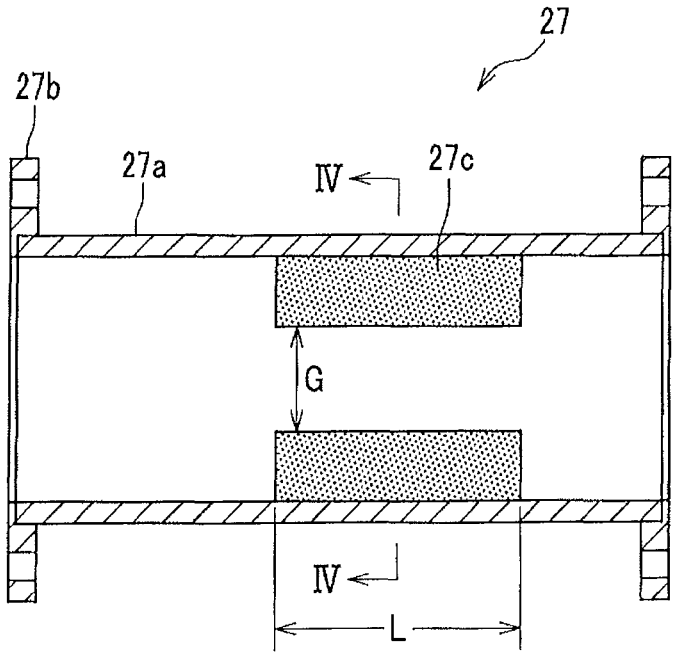
FIG. 4 is an elevation cross section of a filter in the microwave irradiating system according to the first embodiment.
Figure 5:
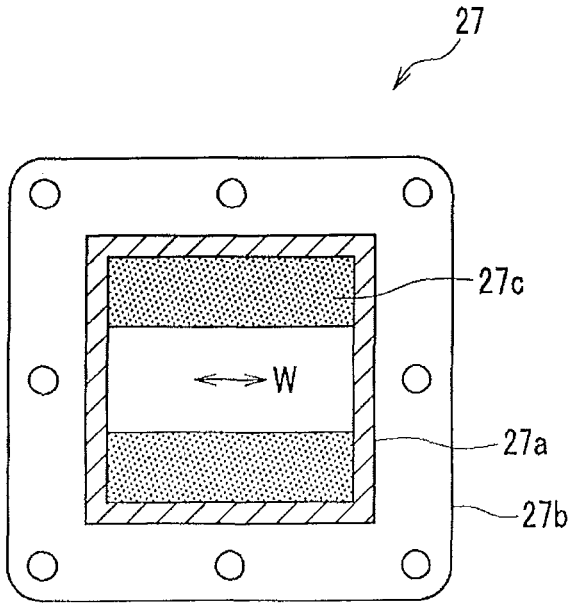
FIG. 5 is a cross section view, taken on line IV-IV in FIG. 4.

In FIGS. 4 and 5, two metal blacks 27*c* of the microwave filter 27 are set to have such dimensions as to stop the microwave from the second microwave generator 3. This configuration reflects the entire microwave from the second microwave generator 3 tending to advance in the direction to the first microwave generator 2 is reflected by the microwave filter 27 and almost all part of the microwave advances in the direction to the applicator 1. Accordingly, the object 12 in the applicator 1 is efficiently irradiated with the microwave.

In other words, the microwave filter 27 prevents the microwave power generated by one microwave irradiation system from propagating to other microwave generator (magnetron) and generating interference and loss with improvement for effective irradiation of the microwave.

As shown in FIGS. 4 and 5, the microwave filter 27 includes a rectangular waveguide 27*a* having the same cross-sectional sizes as the applicator 1 (FIG. 1), rectangular parallelopiped metal block 27*c* on upper and lower inner walls of the rectangular waveguide 27*a*, and a flange 27*b* provided at both ends of the rectangular waveguide 27*a*. Because the microwave transmitted from the first microwave generator 2 has a direction of electric field orthogonal to a longitudinal direction W of a gap between two metal blocks 27*c* (see FIG. 5), the microwave passes through the gap G, and the applicator 1 is irradiated with the microwave from the first microwave generator 2. The microwave transmitted from the applicator 1 is reflected by an inlet and an outlet of the gap G between the metal blocks 27*c*. A length of the metal block 27*c* is set to such a length L that both reflected microwaves are cancelled each other. Accordingly, the microwave filter 27 does not act as a barrier for a transmission path of the microwave from the applicator 1.

Figure 6:
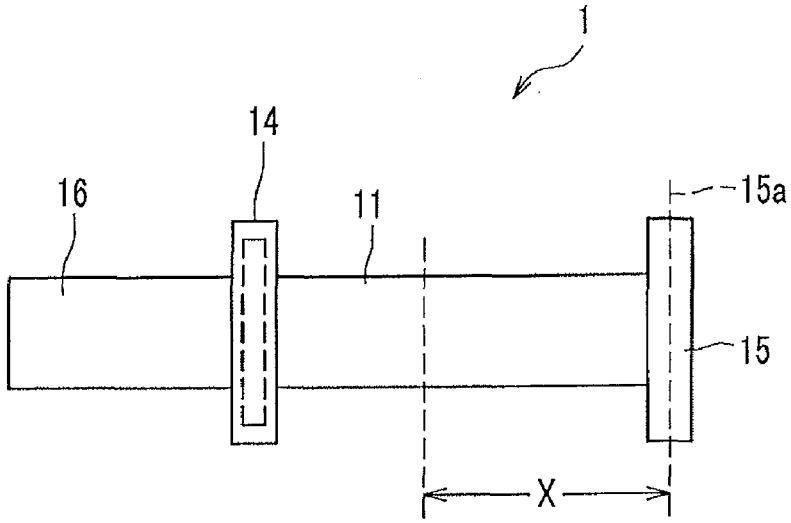
FIG. 6 is a front view of the applicator according to the first embodiment.
Figure 7:
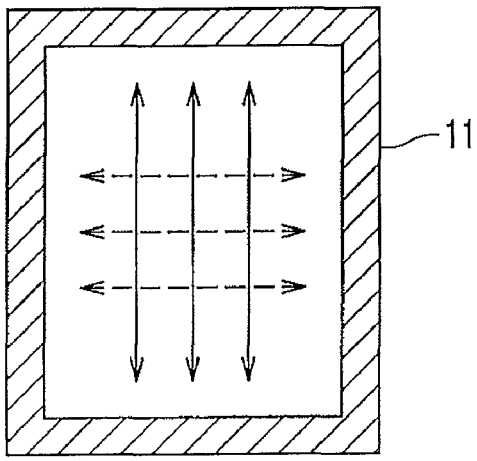
FIG. 7 is a cross section view of a rectangular sleeve in the applicator according to the first embodiment to show direction of electric fields.
Figure 8:
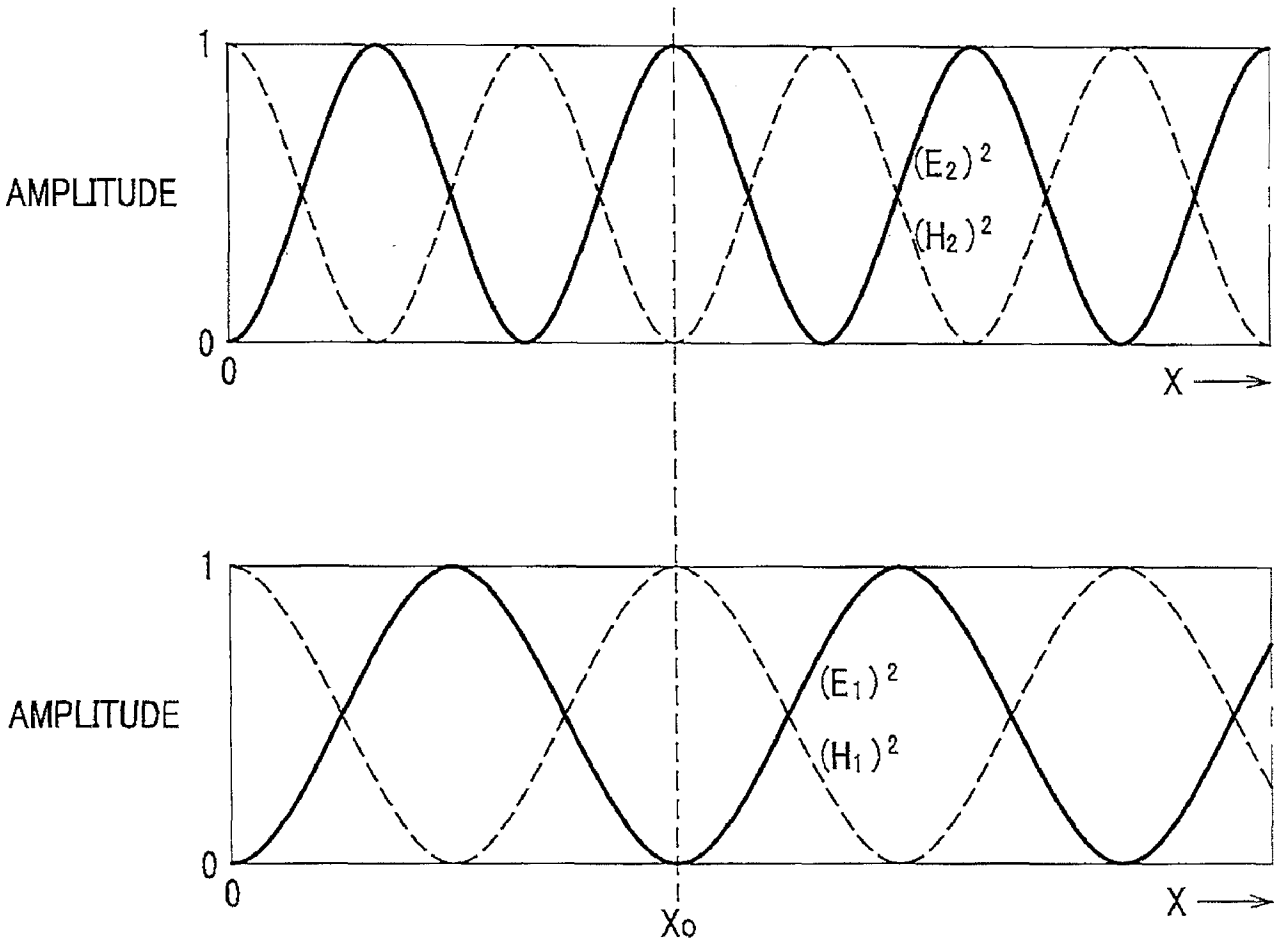
FIG. 8 shows charts showing intensity distributions of electric magnet fields inside the rectangular sleeve in the applicator.

FIGS. 6 to 8 are for explaining how electromagnetic field is generated in the applicator 1. FIG. 6 shows the applicator 1 where two microwave generators 2 and 3 (see FIG. 1) are omitted for easy explanations.

A reflecting plane 15*a* indicates a reflecting plane location in the reflector 15 disposed at an end of the applicator 1. In FIG. 6, X is a distance from a reference location of the reflecting plane 15*a* to a given location in the applicator 1.

FIG. 7 shows an elevation cross section of the rectangular sleeve member 11 at a distance X in the applicator 1 where the vertical dimension is different from the horizontal dimension. A direction of electric field of the microwave irradiated by the first microwave generator 2 is vertical as shown by solid-lines with arrows in FIG. 7. On the other hand, a direction of electric field of the microwave irradiated by the second microwave generator 3 is horizontal as shown by broken lines with arrows in FIG. 7. In other words, the directions of the electric fields caused by the first microwave generator 2 and the second microwave generator 3 are orthogonal with each other as shown by the solid lines with arrows and broken lines with arrows.

FIG. 8 shows variation in squares of electric field intensities of the microwaves generated inside the applicator 1 with the distance X. Axes of abscissas represent the distance X which indicates an observing location. Squares (relative values) of intensities of the electric field and magnetic field generated in the applicator 1 by the first microwave generator 2 are given by curves of $(E_1)^2$ and $(H_1)^2$ in FIG. 8, and squares (relative values) of intensities of the electric field and magnetic field generated in the applicator 1 by the second microwave generator 3 are given by curves of $(E_2)^2$ and $(H_2)^2$ in FIG. 8.

The cross-sectional sizes of the rectangular sleeve member 11 in the applicator 1 are, for example, horizontal inner dimension A1=69.3 mm, and vertical inner dimension A2=86.0 mm, which are different from each other where the horizontal inner dimension is set to be smaller than the vertical inner dimension. Accordingly, a wavelength λ1 in the waveguide of a propagating mode having an electric field E1 in the vertical direction generated in the applicator 1 by the first microwave generator 2 is greater than a wavelength λ2 in the waveguide of a propagating mode having an electric field E2 in horizontal direction generated in the applicator 1 by the second microwave generator 3. A relation between the dimensions A (A1, A2) of the waveguide and wavelengths λ inside the waveguide is generally given by:

$$\lambda = \frac{\lambda_0}{\sqrt{1-\left(\frac{\lambda_0}{2A}\right)^2}}$$

where $\lambda_0$ is a wavelength of the microwave in a free space.

The applicator 1 is provided with the reflector 15 where an electrically short-circuit status is provided. Accordingly, the microwave propagated through the applicator 1 is perfectly reflected by the reflecting plane 15*a*. At the location of the reflecting plane 15*a*, i.e., the distance X=0, both electric field E1 and electric field E2 become zero. Because at a location with distance of X>0 standing waves are formed by interference between the progressive microwaves and reflected microwaves from the reflecting plane 15*a*, when the distance of a measuring point is gradually increased, $(E1)^2$ and $(E2)^2$ largely vary at a half cycle of the wavelength λ inside the waveguide at the measuring point. Because a distribution of the electric field and the magnetic field at a middle of cross section of the waveguide is such that at a location of which electric field is great, the magnetic field is small, and at a location of which electric field is small, the magnetic field becomes great, a distribution of $(H1)^2$ and $(H2)^2$ vary as shown by broken lines in FIG. 8.

As mentioned above, because the electric fields E1 and Es have different wavelength inside the waveguide, as the distance X varies, a difference become large. There is a location such that when $(E2)^2$ shows a maximum value, on the other hand, $(E1)^2$ becomes approximately zero. The magnetic distribution at this location is such that $(H2)^2$ is zero and $(H1)^2$ shows a peak. This location is defined as $X=X_0$. Accordingly, at the location of $X=X_0$, the electric field E2 generated by the second microwave generator 3 and the magnetic field H1 generated by the first microwave generator 2 exist at the same time. When the object 12 is located at this location, it is possible to irradiate the object 12 with the electric field E2 and the magnetic field H1 in which intensities of the electric field E2 and the magnetic field H1 are independently controlled. This is a basic conception of the microwave irradiation apparatus 100 according to the present invention.

Figure 9:
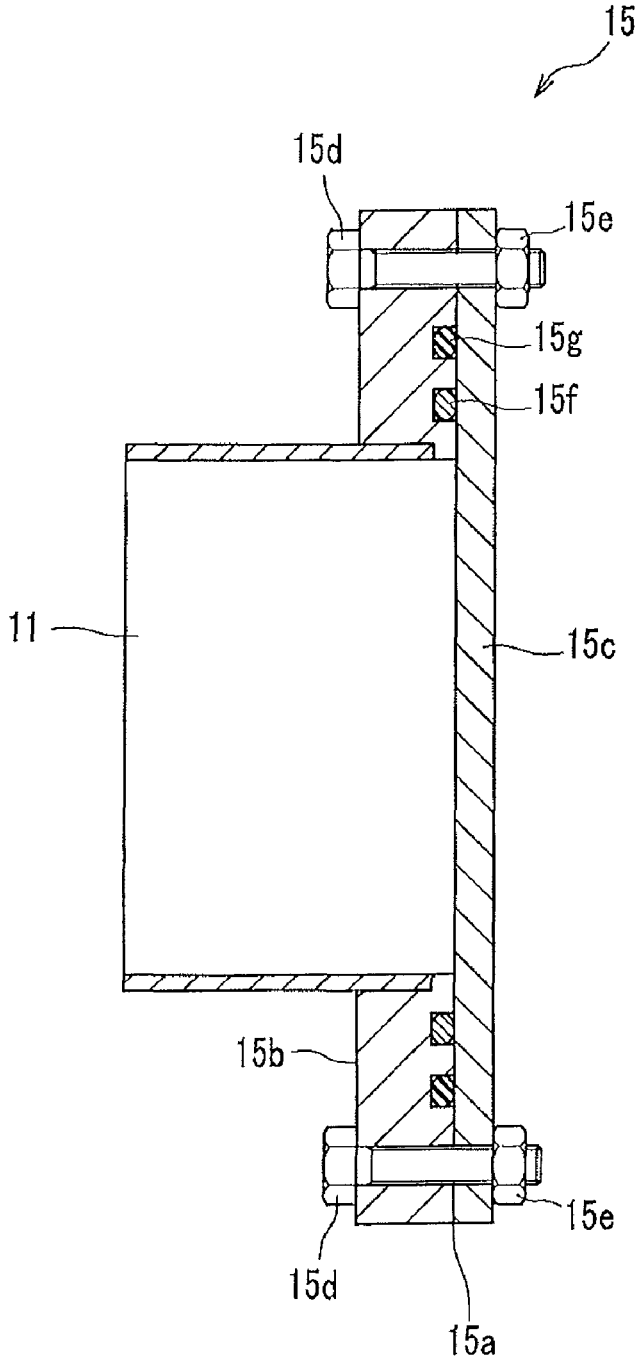
FIG. 9 is an elevation cross section view of a reflector of the microwave irradiation system according to the first embodiment.

FIG. 9 shows an elevation cross section of the reflector 15 of the microwave irradiation system 100 according to the first embodiment. The reflector 15 is formed as follows:

A metal flange 15*b* is fixed to an end of the rectangular sleeve member 11 by soldering. A reflecting plate 15*c* is fixed to the metal flange 15*b* at reflecting plane 15*a* by fastening a plurality of bolts 15*d* and nuts 15*e*. In the reflector 15, to prevent radio wave leakage through small gaps on the reflecting plane 15*a* in contact with the metal flange 15*b*, an electrical conductive gasket 15*f* made of a metal mesh is disposed in a channel in the metal flange 15*b*, and a sealing gasket 15*g* for keeping air tightness is also disposed in another channel adjoining the channel for the electrical conductive gasket 15*f*. These gaskets are sandwiched between the metal flange 15*b* and the reflecting plate 15*c*. The sealing gasket 15*g* is made of silicone rubber or plastic which is protected from microwave heating by the electrical conductive gasket 15*f* which prevents the microwave from leaking.

Figure 10:
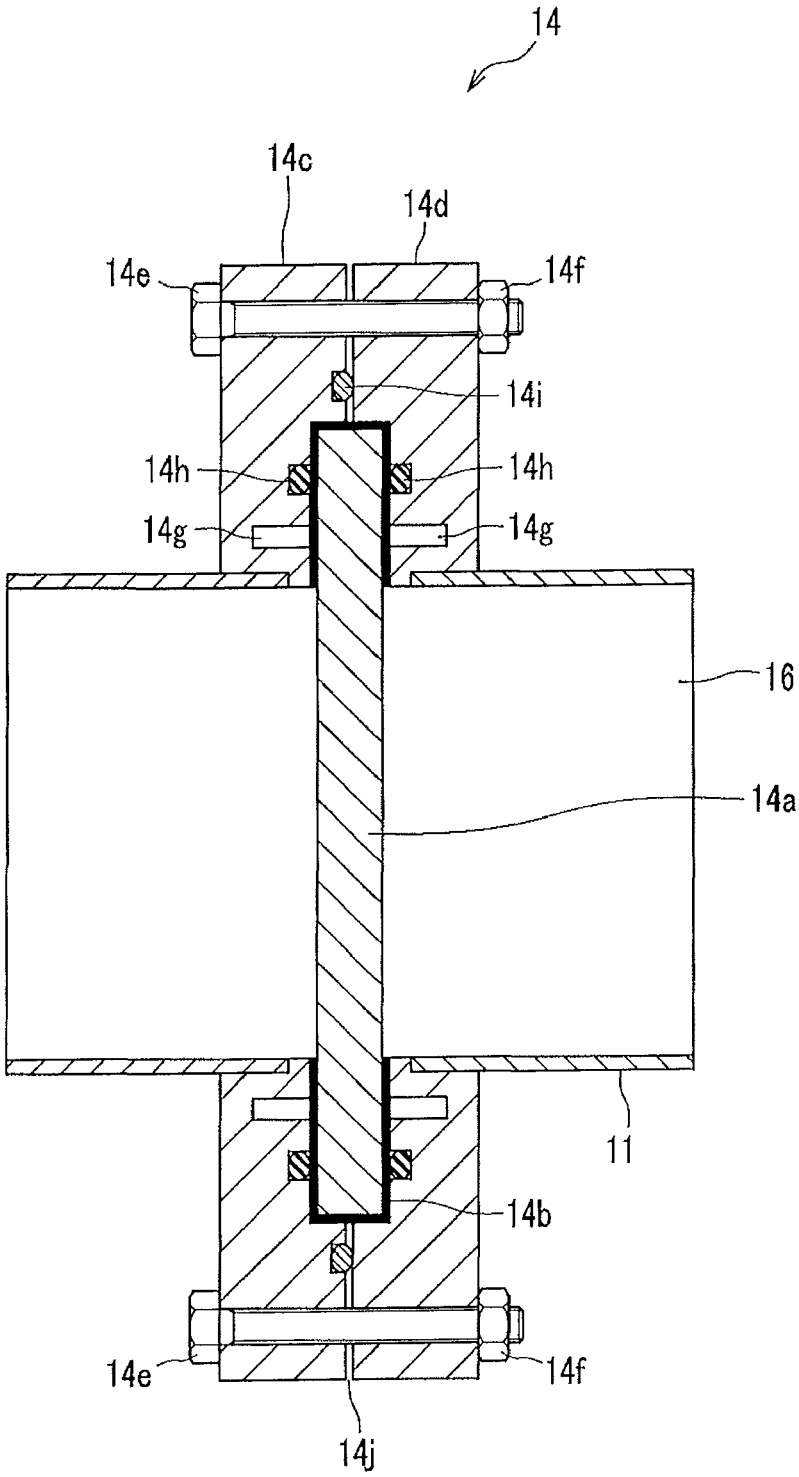
FIG. 10 is an elevation cross section view of a separation window of the microwave irradiation system according to the first embodiment.

FIG. 10 shows an elevation cross section of the separation window 14 of the microwave irradiation system 100 according to the first embodiment. In the separation window 14, a window flange 14*d* made of a metal is fixed on an outer surface of the other end of the rectangular sleeve member 11 by soldering, and a window flange 14*c* made of a metal is fixed to an outer surface of an end of the connecting member 16 by soldering.

The separation window 14*a* comprises a rectangular plate made of alumina ceramic which is plated with metal except a center surface corresponding to a microwave propagating space in the rectangular sleeve member 11. In the separation window part 14, the separation window 14*a* is sandwiched between the window flanges 14*c* and 14*d* which are fasten with a plurality of bolts 14*e* and nuts 14*f*. The window flanges 14*c* and 14*d* are formed to have cross sections of rectangular frame shape. In facing surfaces, the window flange 14*c* and 14*d* has channels in a ring shape or a rectangular shape into which sealing members are disposed and through holes through which bolts 14*e* penetrate. In the separation window part 14, in contact surfaces between a metal-plated part 14*b* on the separation window 14*a* and the separation flange 14*c*, 14*d*, a λ/4 chokes 14*g* are disposed and sealing gaskets 14*h* are sandwiched between the metal-plated part 14*b* on the separation window 14*a* and the separation flange 14*c* and 14*d* to keep air tightness.

The electrical conductive gasket 14*h* comprises an O ring made of a plastic such as silicone rubber and Teflon (registered trademark). However, the electrical conductive gasket 14*h* is protected from the microwave heating on the electrical conductive gasket 14*h* because the λ/4 choke 14*g* prevents the microwave from leaking between the contact surfaces. As mentioned above, because the separation window 14*a* is sandwiched between the window flange 14*c* and the window flange 14*d*, to absorb dispersion in part size a minute gap 14*j* is provided.

Because the λ/4 choke 14*g* is optimized to a fundamental wave of the microwave, the λ/4 choke 14*g* cannot sufficiently stop harmonic components such as the second harmonic components to fifth harmonic components, so that harmonic components may be leaked through the minute gap 14*j*. The electrical conductive gasket 14*i* prevents harmonic components of the microwave from leaking outside.

Figure 11:
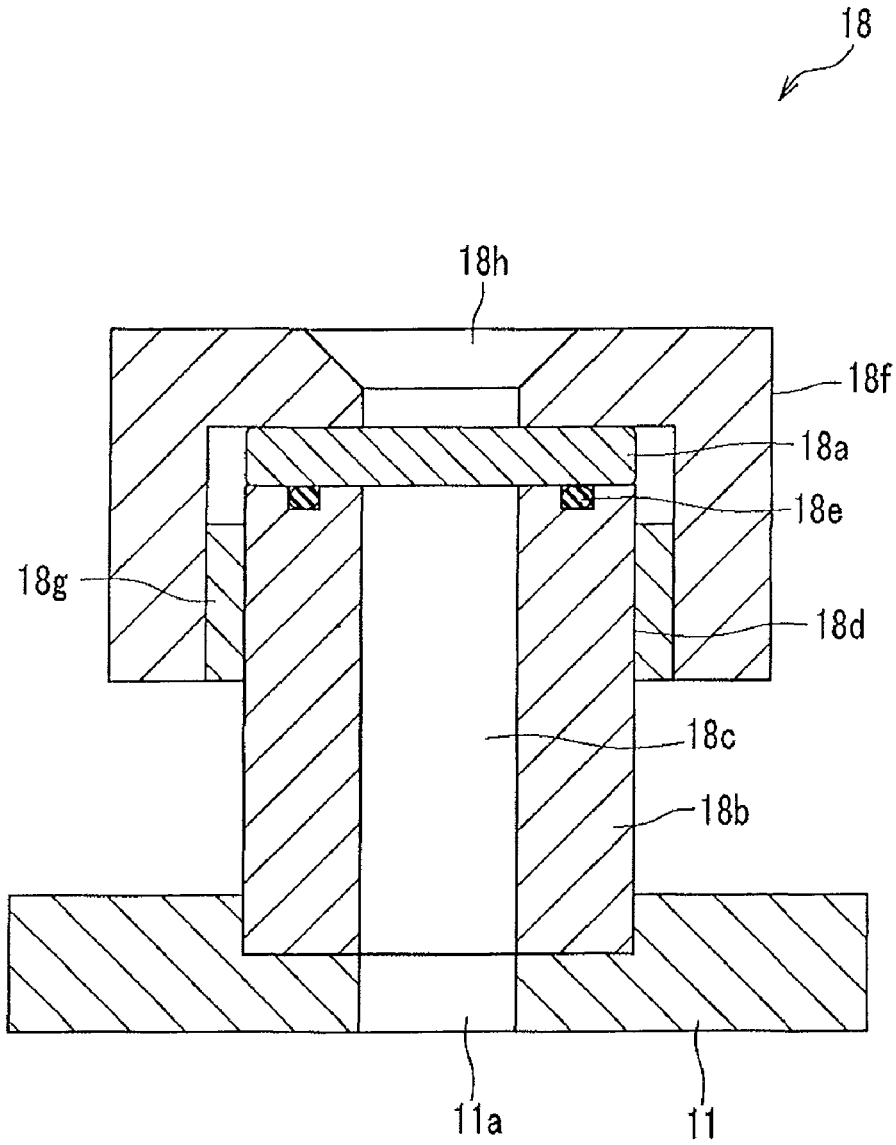
FIG. 11 is a cross section of an observing window of the microwave irradiation system according to the first embodiment.

FIG. 11 shows an elevation cross section of the observing window 18 of the microwave irradiation system 100 according to the first embodiment. The observing window 18 is provided on a side surface of the rectangular sleeve member 11, and a metal sleeve 18*b* having a center hole 18*c*, and an end of the metal sleeve 18*b* is fixed to the side surface of the rectangular sleeve member 11 by soldering. In the observing window 18, a quartz glass disc 18*a* is disposed on the other end of the metal sleeve 18*b* and screw-fastened by screwing a thread 18*g* on a fastening metal member 18*f* and a thread 18*d* on the metal sleeve 18*b* after engagement therebetween. An air tight sealing gasket 18*e* is inserted in a channel in the metal sleeve 18*b* and sandwiched between the other end of the metal sleeve 18*b* and the quartz glass disc 18*a*. An inner diameter of the center through hole 18*c* of the metal sleeve 18*b* is made sufficiently smaller than a cutoff wavelength of the microwave, which stops leakage of the microwave. A center hole 18*h* is a through hole covering the quartz glass disc 18*a* for observation in the fastening metal member 18*f*, and the rectangular sleeve member 11*a* is a through hole formed in the rectangular sleeve member 11.

The first embodiment provides the above-mentioned configuration, that is, one applicator 1 for containing and supporting the object 12 allow the object to be efficiently irradiated with energy of the microwave from at least two microwave generators 2 and 3. One of the microwave generators 2 and 3 allows the object 12 (or a space where the object 12 is to be placed) to be irradiated with the microwave electric field, and the other microwave generator allows the object in the applicator 1 to be irradiated with the microwave magnetic field. In this configuration, because the electric field and the magnetic field are supplied from independent microwave generators, the electric field and the magnetic field at the object 12 can be independently controlled. Generally if one location is irradiated with microwave energy from two microwave generators 2 and 3, it is impossible to keep predetermined electric field or magnetic field because two microwaves interfere with each other. In the first embodiment, polarization planes of the microwave irradiation mode for the electric field irradiation and the microwave irradiation mode for the magnetic field irradiation are orthogonal to avoid mutual interference.

In addition, at the object 12 (or the space at which the object 12 is placed) a phase of the microwave irradiation mode for irradiating the electric field is made to have a peak of the electric field intensity and a minimum of the magnetic field intensity. On the other hand, a phase of the microwave irradiation mode for irradiating the magnetic field is made to have a peak of the magnetic field intensity and a minimum of the electric field intensity at the object 12. According to the configuration, controlling the microwave generator for irradiating the electric field can adjust the intensity of the electric field at the object 12 independently. Controlling the microwave generator for irradiating the magnetic field can adjust the intensity of the magnetic field at the object 12 independently.

According to the configuration, the object (or the space on which the object is placed) is irradiated with both the magnetic field and the electric field of which intensities are independently controlled. Accordingly, the microwave irradiation apparatus according to the first embodiment provides efficient irradiation of the electric field and the magnetic field in various chemical reaction systems and heat processing systems. In addition, simultaneous irradiation of the electric field and the magnetic field of which intensities are independently controlled provides a most efficient microwave irradiation method and a high efficient apparatus using microwave power.

In the first embodiment, it is possible to irradiate the object 12 at a fixed location with both the magnetic field and electric field simultaneously and to irradiate the object 12 at the fixed location with either of the magnetic field or electric field. The switching between the magnetic field and the electric field can be provided by not a mechanical operation. This configuration easily provides a microwave power application system for irradiating the magnetic field and electric field toward the object in a pressurized or pressure-decreased space. When this configuration is used in an apparatus for chemical reaction using microwave, it is possible to heat the object irradiated with both magnetic field of the microwave and electric field of another microwave in such a status that object 12 is mixed with a material capable of dielectric heating or the object 12 is contained in or covered by a container made of a material capable of dielectric heating. This system permits a temperature control of the object with the electric field irradiation as well as a chemical reaction based on the magnetic irradiation simultaneously.

Second Embodiment

Figure 12:
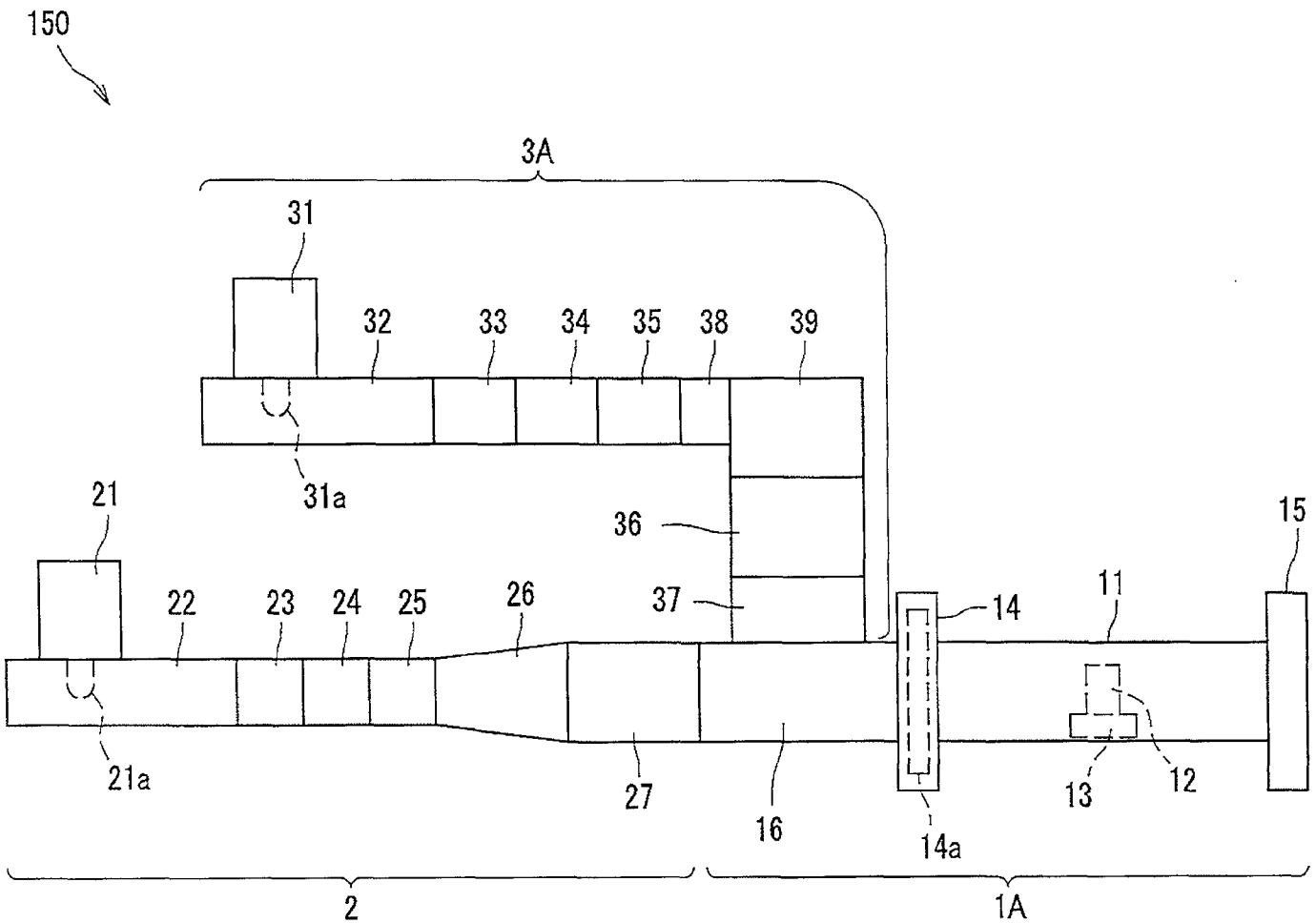
FIG. 12 is a front view of a microwave irradiation system according to a second embodiment.
Figure 13:
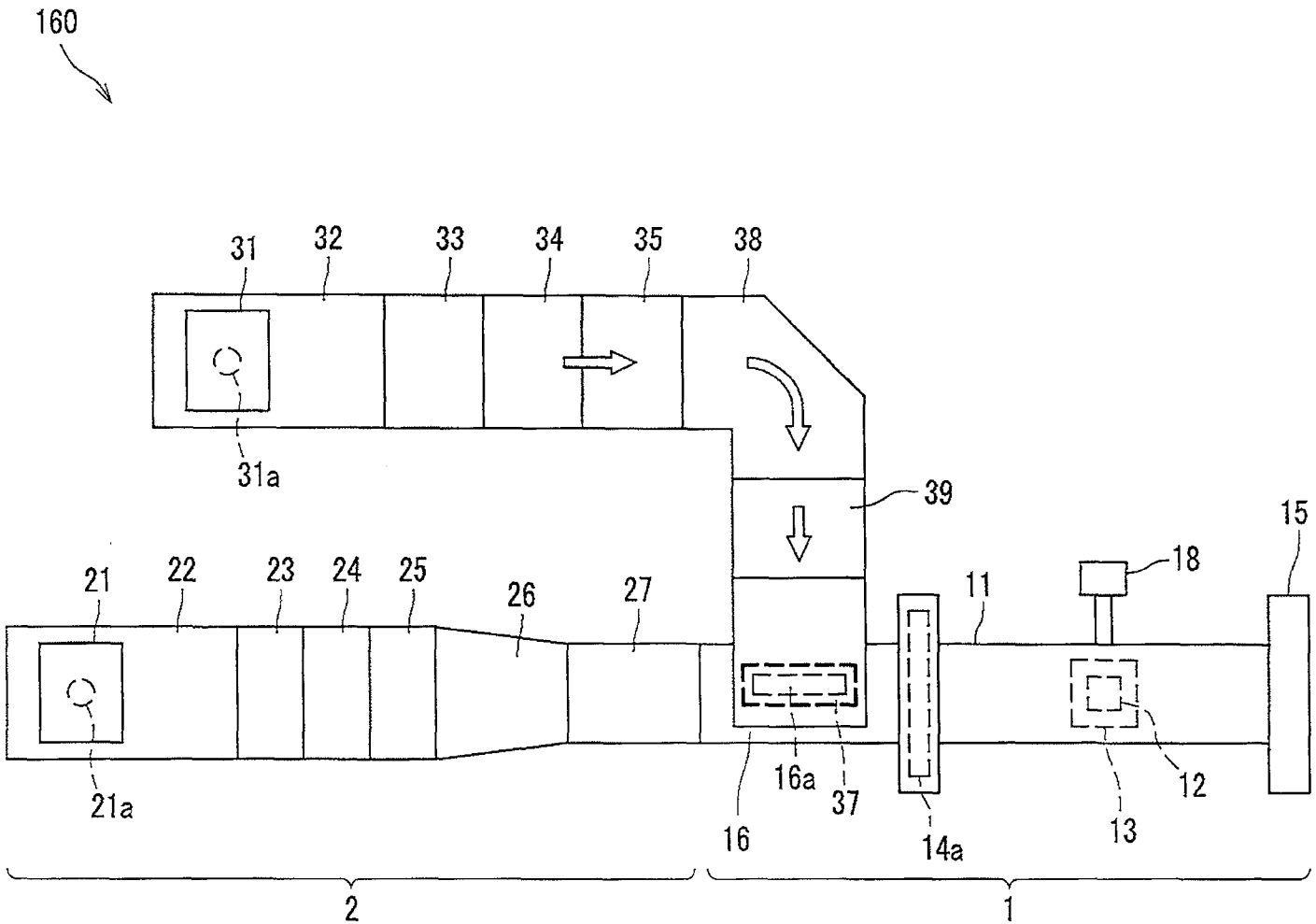
FIG. 13 is a plan view of the microwave irradiation system according to the second embodiment of the present invention.

FIG. 12 shows a front view of a microwave irradiation system according to a second embodiment. FIG. 13 shows a plan view of the microwave irradiation system according to the present invention. The microwave irradiation system according to the first embodiment has a mechanical unstableness because the second microwave generator 3 is vertically disposed on the applicator 1. On the other hand, the microwave irradiation apparatus 150 includes a second microwave generator 150 having a folded shape to partially have horizontally extending part to improve a mechanical stability and space efficiency.

Elements in the second embodiment are substantially identical to those in the first embodiment and designated with the same or like references to omit detailed descriptions. An H-plane corner part 38 and an E-plate corner part 39 are added to the configuration according to the first embodiment, i.e., are inserted between the tuner 35 and the taper tube 37. A propagation direction of the microwave in the second microwave generator 3A is change by 90 degree in a horizontal plane. Next the propagation direction is changed to downward by the E-plane corner part 39.

Figure 14:
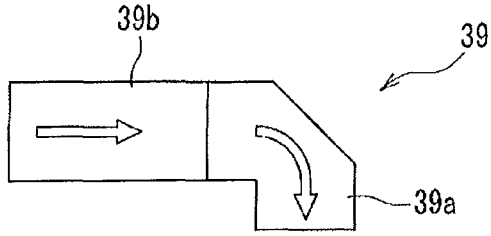
FIG. 14 is a left side view of the E-plane corner part.

FIG. 14 shows a left side view of the E-plane corner part 39. The E-plate corner part 39 includes a short connection waveguide 39*b* and a following E corner 39*a* perpendicularly bent. As shown by arrows in FIG. 14, a direction of the radio wave is finally changed downward by 90 degree to allow the microwave to be smoothly incident in the oblong opening 16*a* of the applicator 1 shown in FIG. 13. In the second embodiment, because both the first microwave generator 2 and the second microwave generator 3A are horizontally disposed, the second microwave generator 3A can be stably supported, and a space efficiency can be improved. If it is desirable to equalize supporting positions of the first microwave generator 2 and 3A at a same plane, waveguide components such as a connection waveguide are additionally used to the H-plane corner part 38 and the E-plate corner part 39.

Figure 15:
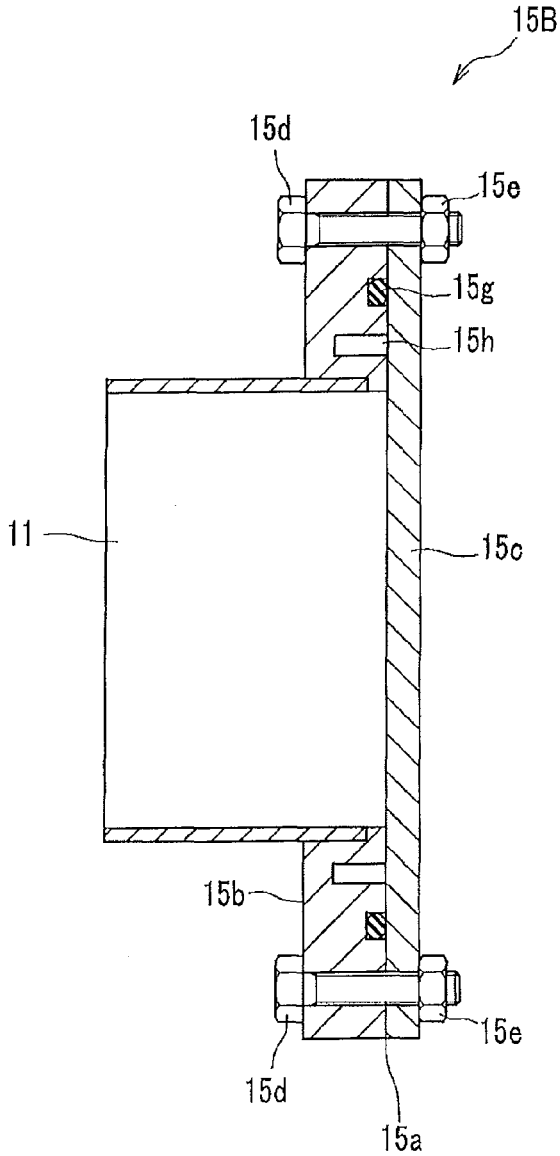
FIG. 15 is an elevation cross section view of a reflector which is a modification of the reflector shown in FIG. 9.

FIG. 15 shows an elevation cross section of the reflector 15B which is a modification of the reflector 15 shown in FIG. 9. The reflector 15B includes a λ/4 choke 15*h* in place of the electrical conductive gasket 15*f* shown in FIG. 9. The reflector 15B is formed as follows:

A metal flange 15*b* is fixed to an end of the rectangular sleeve member 11 by soldering. A reflecting plate 15*c* is fixed to the metal flange 15*b* at reflecting plane 15*a* by fastening a plurality of bolts 15*d* and nuts 15*e*.

In the reflector 15B, to prevent radio wave leakage through minute gaps on the reflecting plane 15*a* in contact with the metal flange 15*b*, the λ/4 choke 15*h* and the sealing gasket 15*g* for keeping air tightness is also disposed in another channel adjoining the channel for the electrical conductive gasket.

[Modifications]

Figure 16:
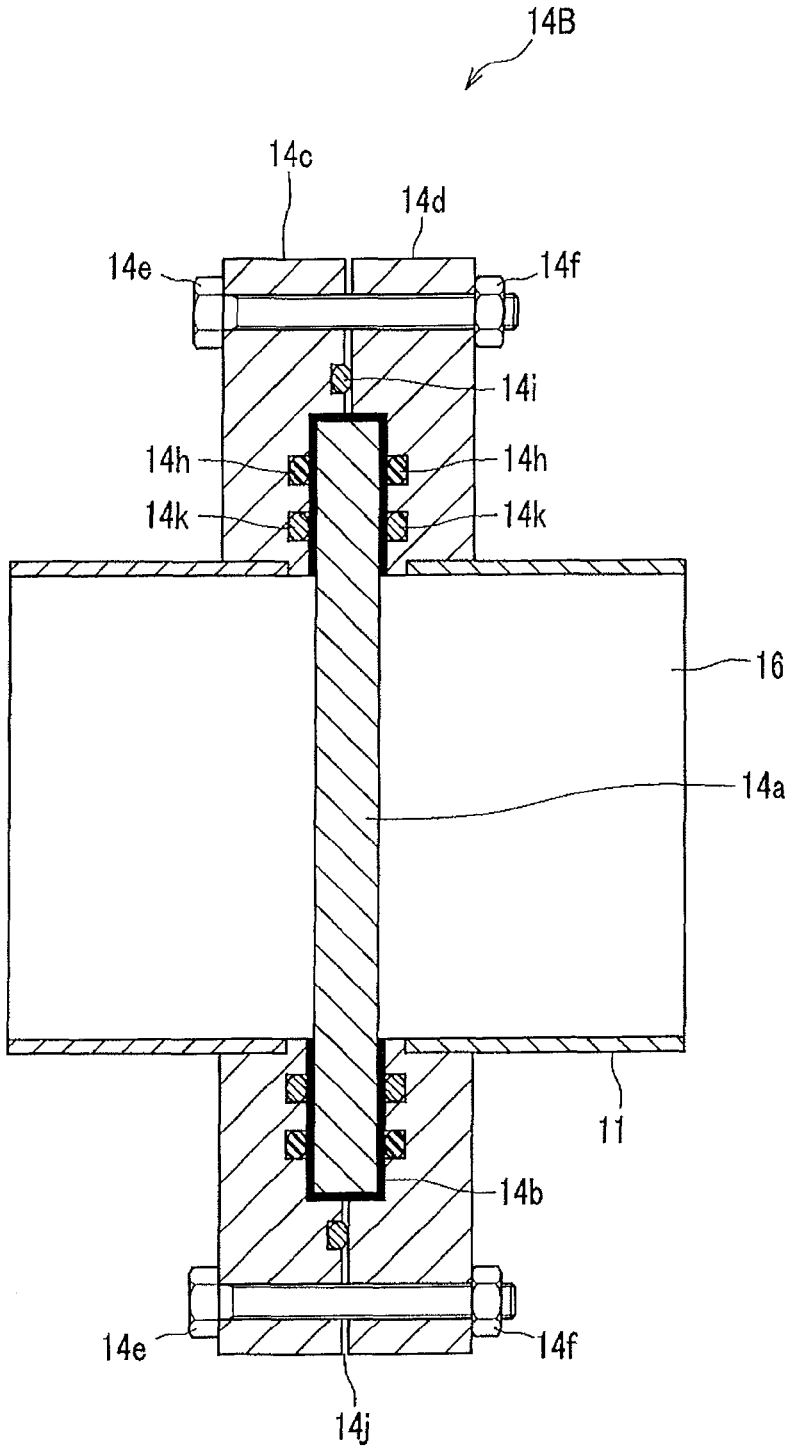
FIG. 16 is an elevation cross section view of a separation window of the microwave irradiation apparatus which is a modification of the separation window shown in FIG. 10.

FIG. 16 shows an elevation cross section of the separation window 14 of the microwave irradiation apparatus which is a modification of the separation window shown in FIG. 10. The separation window part 14B includes the conductive gasket 14*k* in place of the λ/4 choke 14*g* shown in FIG. 10. In the separation window 14A, because the electrical conductive gasket 14*k* electrically short-circuits harmonic wave components in addition to the fundamental components, it is not always necessary to dispose the electric conductive gasket 14*i*. This provides a double leakage stop.

FIG. 16 shows an elevation cross section of the separation window part 14B which is a modification of the separation window part 14 shown in FIG. 10. In the separation window part 14B, the separation window 14*a* comprises an alumina ceramic plate having a rectangular shape in which the metal plating on the sufferance thereof is omitted. An electrical conductive gasket 14*k* comprises a metal mesh for protecting an unnecessary radio wave emission through gaps 14*j*. In the separation window part 14B, sealing gaskets 14*h* are sandwiched between the surface of the separation window 14*a* and the window flange 14*c*, 14*d*. A position of the electrical conductive gasket 14*h* is determined to be a location near the electrical conductive gasket 14*k* to avoid heat generation by the microwave electric field.

Figure 17:
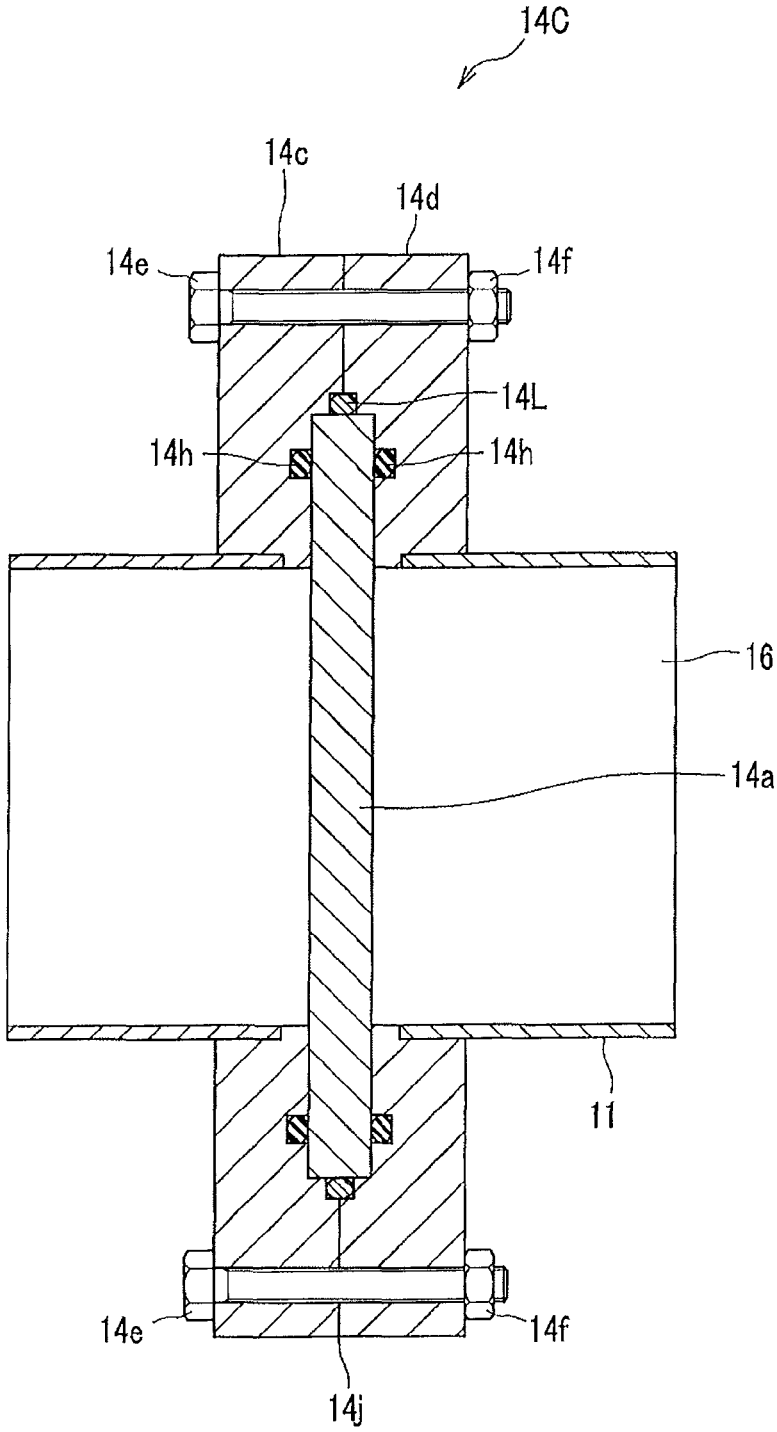
FIG. 17 is an elevation cross section view showing another modification of the separation window.

FIG. 17 shows another modification of the separation window 14C in which a metal plating is omitted. The electrical conductive gasket 14*h* is disposed at a location where a strength of the electric field is small. However, the separation window part 14C is subjected to the microwave heating easier than the separation windows 14A (FIG. 10) and 14B (FIG. 16). In other words, the separation windows 14 and 14B are more suitable to the microwave radiation system having a higher output.

Figure 18:
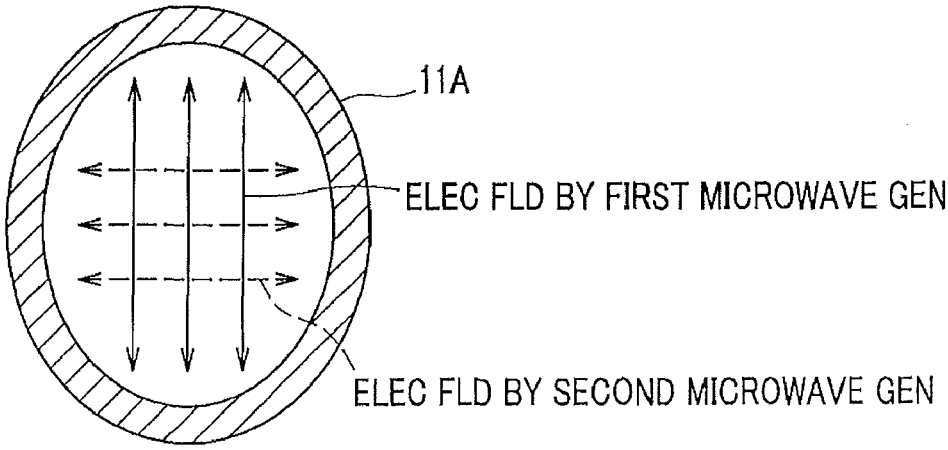
FIG. 18 is a cross section view of a sleeve having an oval cross section shape used in place of the rectangular sleeve of the applicator of the microwave irradiation system according to the present invention.
Figure 19:
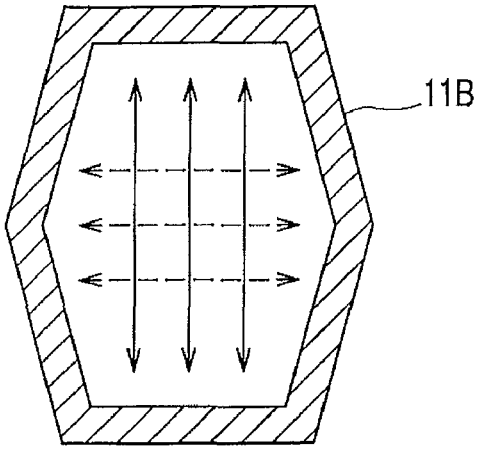
FIG. 19 is a cross section view of a sleeve having a polygonal cross section used in place of the rectangular sleeve of the applicator of the microwave irradiation system according to the present invention.

FIGS. 18 and 19 show modification of the rectangular sleeve 11. The rectangular sleeve 11 shown in FIG. 7 has a parallelogram cross section. The sleeve 11A shown in FIG. 18 has an oval cross section. The sleeve 11B shown in FIG. 19 has a polygonal (hexagon) cross section. These sleeves having such cross section shapes also can provide the operation similarly to the embodiment shown in FIG. 9 by differentiating horizontal and vertical dimensions of the cross section in which two microwaves are fed such that two microwave electric fields (magnetic waves) are orthogonal and wavelengths in waveguide are differentiated.

The configurations in the first and second embodiment first enable the magnetic field and the electric field to be independently controlled at the same time at the object 12 (a space on which the object is placed).

In the first and second embodiment, the first microwave generator 2 and the second microwave generator 3 generates the microwave at the band of 2450 MHz. However, the first microwave generator 2 and the second microwave generator 3 may generate microwave at other microwaves, for example, 5800 MHz band or 915 MHz. In such a case, dimensions of the rectangular sleeve 11, a connection part, the reflector 15, the separation window part 14, the connecting member 16 of the applicator 1 and other related microwave devices are correspondingly changed, thereby providing the same advantageous effect.

The distance $X_0$ shown in FIG. 8 may be shifted in accordance with a dimension or a material of the inspection object 12 and the dimension of the supporting member 13 comprising an insulator for supporting the object. Then it is preferable to place the object 12 and the supporting member 13 at an optimum location through a microwave electromagnetic simulation or a microwave electromagnetic field measurement. There may be a method of changing a reflecting point by inserting a metal spacer in the microwave reflector. In addition, a method of variable reflection plate configuration may be provided.

In the first and second embodiments, at the observing position $X=X_0$, the object 12 is irradiated at the same time with the electric field E2 and the magnetic field H1 which are independently controlled. However, the electric field E1 and the magnetic field H2 in place of the electric field E2 and the magnetic field H1, may be irradiated at the same time by changing an inner dimension of the rectangular sleeve member 11 of the applicator 1 or selecting a place of $X_0$.

In FIGS. 9 and 15, description has been made such that the air-tight seal gaskets comprise O rings made of plastic. However, in place of this, it is possible to provide a configuration meeting air-tightness and electric conductivity with soft metal member such as copper. In such a case, the electric conductive gasket 15*g* and the λ/4 choke 15*h* may be omitted. Similarly to the electrical conductive gasket 14*h* shown in FIGS. 10 and 16, the electric conductive gasket 14*k* and the λ/4 choke 14*g* may be omitted as copper gasket having both air-tightness and electric conductivity.

The electric conductive gasket 14*i* is an additional for assisting functions of the electric conductive gasket 14*k* and the λ/4 choke 14*g*, and thus may be omitted. In accordance with a radio wave leaking test result, the electric conductive gasket 14*i* can be inserted as necessary.

In the first and second embodiments, the applicator 1 has the configuration such that the object 12 is inserted and taken out in a status that the reflector 15 is removed. However, this may be done with a lock mechanism using a simple handle mechanism in place of fixing the reflector 15 with bolts and nuts. In addition, there may be a configuration for this purpose. That is, a metal part is provided at a bottom of the rectangular sleeve member 11 detachably. The metal part is moved downward as the object 12 and the supporting member 13 are placed on the metal part, and then, the object is inserted and taken out.

In the first and second embodiments, the object 12 (the space on which the object is placed) is radiated with the electric field and the magnetic field independently at the same time. In addition, it is possible to increase or decrease the air pressure in the applicator 1 where the object is placed. However, the microwave irradiation system is not limited to this configuration. The air pressure may be the atmospheric pressure.

Figure 21:
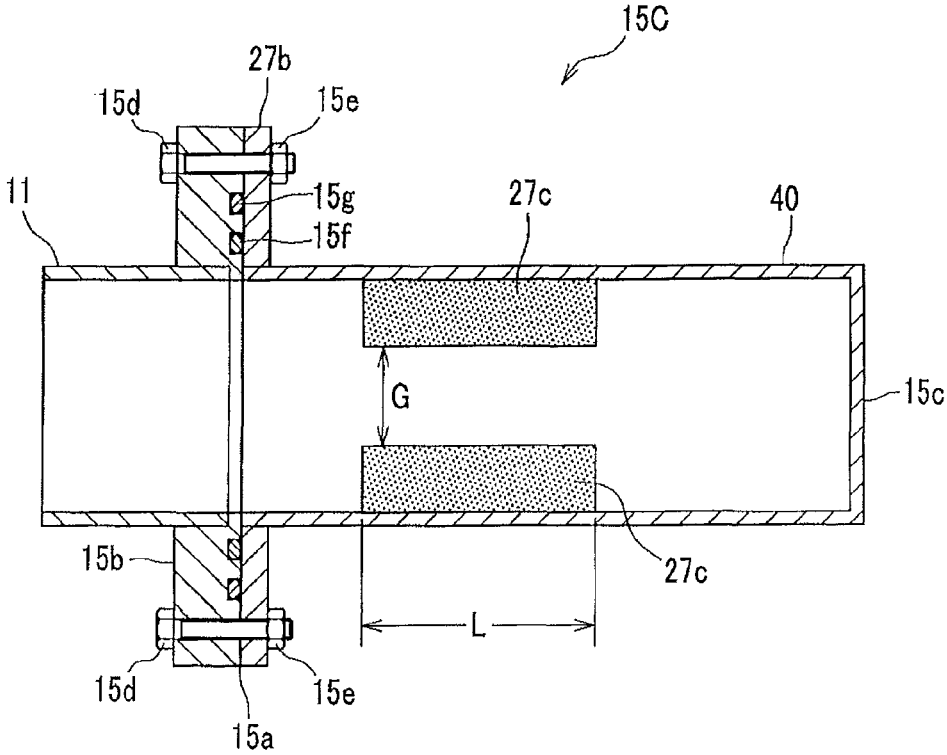
FIG. 21 is a cross section of the reflector shown in FIG. 20.

In FIGS. 1 and 2, the reflector 15 is provided by the reflecting plate 15*c* comprising a simple flat plate. However, as shown in FIG. 21, the reflecting plate 15*c* may further comprise a connection waveguide 40. The reflector 15C may further include metal blocks 27*c* fixed on upper and lower inner walls of the connection waveguide 40 to have a function of the microwave filter 27. This allows the reflecting plate 15*c* to be effective to the microwave generated by the first microwave generator 2 to reflect the microwave at the place of the reflecting plate 15*c* and the microwave generated by the second microwave generator 3 to be perfectly reflected at the entrance of the metal blocks 27*c* by setting of a gap G between the metal blocks 27*c* identical to a cutoff wavelength. In other words, the microwave from the first microwave generator 2 and the second microwave generator 3 can be perfectly reflected at different places. When these places are appropriately set, the intensity of the magnetic field (electric field) by the microwave generated by the first microwave generator 2 is maximum and the intensity of the electric field (magnetic field) by the microwave generated by the first microwave generator 3 is maximum.

Figure 20:
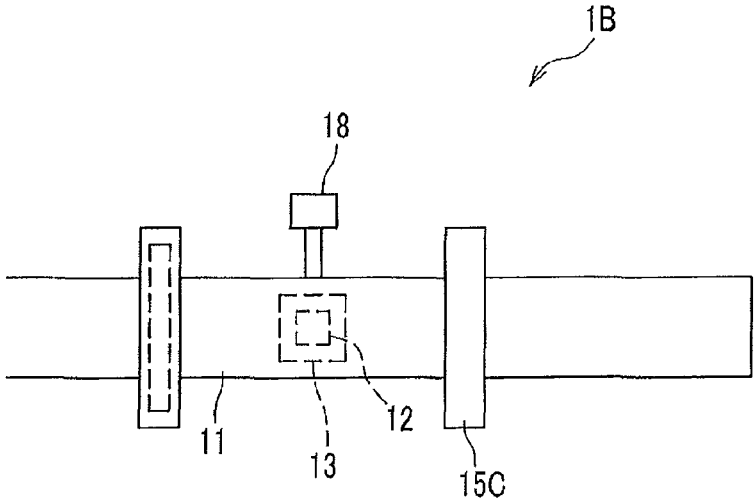
FIG. 20 is a partial plan view showing the microwave reflector which is connected to the applicator shown in FIG. 1.

In the case of the reflector 15 having a simple flat reflecting plate, a location showing a maximum magnetic field and a location showing a maximum electric field is controlled by setting appropriate values for vertical and horizontal dimensions at the applicator 1. Use of the microwave reflector 15C shown in FIG. 21 provides a higher degree of freedom in setting the dimensions of the cross section of the applicator 1. For example, it is possible to make the vertical and horizontal dimensions identical. FIG. 20 is a partial plan view showing the microwave reflector 15C shown in FIG. 21 is connected to the applicator 1 shown in FIG. 1.

In each of the embodiments a series components including the taper tube 26 and the microwave filter 27 is provided in the first microwave generator 2. However, the series components may be provided in the second microwave generator 3 and in both the first microwave generator 2 and the second microwave generator 3.

As mentioned above, the present invention provides a microwave irradiation system comprising:

first and second microwave generators 2, 3, each comprising a microwave irradiating element 21, 31 and a microwave transmission part (22-27, 32-37) comprising at least one of a waveguide and a coaxial tube;

an applicator 1 comprising:

a microwave transmission part (11,14, 16) connected to the first and second microwave transmission parts of the first and second microwave generators at one end thereof;

a reflecting plane 15*a*, at an other end of the microwave transmission part of the applicator 1, configured to reflect microwaves from the first and the second microwave generators to generate an electromagnetic mode at such a location $X_0$ that a space of an object to be irradiated, in the microwave transmission part of the applicator 1 between the end and the other end is irradiated with both an electric field having a first electric field intensity and a magnetic field having a first magnetic field intensity generated by the first microwave generator and with both a magnetic field having a second magnetic intensity and an electric field having a second electric field intensity generated by the second microwave generator, wherein the first magnetic field intensity is greater than the second magnetic intensity and the first electric field intensity is smaller than the second electric field intensity; and a filter part 27 through which at least one of the first and second microwave generators is connected to the applicator 1.

The invention claimed is:

1. A microwave irradiation system comprising:

first and second microwave generators, each comprising a microwave irradiating element and a microwave transmission part comprising at least one of a waveguide and a coaxial tube;

an applicator comprising:

a microwave transmission part connected to the first and second microwave transmission parts of the first and second microwave generators at one end thereof; and a reflecting plane, at another end of the microwave transmission part of the applicator, configured to reflect microwaves from the first and the second microwave generators to generate an electromagnetic mode at such a location that an object is irradiated in the microwave transmission part of the applicator between the one end and the another end, the object being irradiated with both an electric field having a first electric field intensity and a magnetic field having a first magnetic field intensity generated by the first microwave generator and with both a magnetic field having a second magnetic intensity and an electric field having a second electric field intensity generated by the second microwave generator, wherein the first magnetic field intensity is greater than the second magnetic intensity and the first electric field intensity is smaller than the second electric field intensity; and a filter part through which at least one of the first and second microwave generators is connected to the applicator, wherein the filter part comprises metal blocks in the microwave transmission part of the at least one of the first and second microwave generators with a gap between the metal blocks across a predetermined length along the microwave transmission part; wherein the predetermined length is determined such that reflections of the microwaves from the at least one of the first and second microwave generators on the side of the filter part at an inlet and outlet of the gap are canceled out; and a filter, between the one end of the microwave transmission part of the applicator and the reflecting plane, is configured to transmit the microwaves from the at least one of the first and second microwave generators and reflect the microwaves with a polarization plane orthogonal to the microwaves from the at least one of the first and second microwave generators.

2. The microwave irradiation system as claimed in claim 1, wherein the microwave transmission part of the applicator comprises a sleeve comprising an electric conductor material and has a rectangular cross section, a connection part between the applicator and the first microwave generator and between the applicator and the second microwave generator have a rectangular cross section, dimensions of the rectangular cross section of the sleeve are so determined as to differentiate wavelengths in the sleeve by the microwaves from the first and second microwave generators, and a polarization plane of electric field of electromagnetic mode generated by one of the first and second microwave generators is orthogonal with a polarization plane of electric field of electromagnetic mode generated by the other of the first and second microwave generators.

3. The microwave irradiation system as claimed in claim 1, wherein the filter part has a configuration that transmits the microwaves from one of the first and second microwave generators and stops the microwaves from the other of the first and second microwave generators having a polarization plane orthogonal to that of the microwaves from the one of the first and second microwave generators.

* * * * *